United States Patent [19]

Grau

[11] 3,934,830

[45] Jan. 27, 1976

[54] SPOOLING MECHANISM

[75] Inventor: Gerhard Grau, Albershausen, Germany

[73] Assignee: Zinser Textilmaschinen GmbH, Ebersbach, Germany

[22] Filed: May 28, 1974

[21] Appl. No.: 473,758

[30] Foreign Application Priority Data

May 28, 1973 Germany ..... 2327164

[52] U.S. Cl. ..... 242/18 DD; 242/36; 242/37; 242/39

[51] Int. Cl.[2] ..... B65H 54/42

[58] Field of Search ..... 242/18 DD, 18 R, 18 B, 242/36, 37, 39

[56] References Cited

UNITED STATES PATENTS

| | | | |
|---|---|---|---|
| 3,016,205 | 1/1962 | Barnes, Jr. | 242/18 DD |
| 3,241,778 | 3/1966 | Bourgeas | 242/18 DD |
| 3,299,990 | 1/1967 | Ratcliffe | 242/18 DD X |
| 3,355,116 | 11/1967 | Conrad | 242/18 DD |
| 3,460,771 | 8/1969 | Kimpton | 242/18 DD |
| 3,667,205 | 6/1972 | Brazda et al. | 242/37 R X |
| 3,677,482 | 7/1972 | McKenzie | 242/18 DD X |
| 3,697,007 | 10/1972 | Taylor et al. | 242/18 DD |
| 3,807,647 | 4/1974 | Miller | 242/18 DD |
| 3,841,574 | 10/1974 | Lenk et al. | 242/18 DD |

*Primary Examiner*—Stanley N. Gilreath
*Attorney, Agent, or Firm*—Edwin E. Greigg

[57] ABSTRACT

A spooling mechanism, for the spooling or winding of textile threads includes at least one spool having a circumferential surface, presses against a driven winding shaft or the like which is mounted on a pivoting spool holder which pivots during increasing spool diameter, further pivoting permits the lifting of the spool off from the winding shaft. A linear servomotor is provided with a working member which can be driven with respect to a guide member. The working member serves to displace temporarily the spool holder and itself is displaceable by the spool holder. A locking mechanism, which is preferably a clamping mechanism, is provided, making it possible for the working member to execute its working stroke relative to the guide member while carrying along the spool holder.

22 Claims, 9 Drawing Figures

SPOOLING MECHANISM

BACKGROUND OF THE INVENTION

This invention relates to a spooling mechanism for the spooling or winding of textile threads. The invention relates, more particularly, to a spooling mechanism for the winding of textile fibers, which mechanism includes at least one spool whose circumference presses against a driven winding shaft or the like and which is mounted on a pivoting spool holder. The spool holder is pivoted during increasing spool diameter; further pivoting permits lifting the spool off from the winding shaft. A linear servomotor, which includes a working member, is provided. The working member can be driven with respect to a guide member for the purpose of executing a lifting displacement. The working member serves for the temporary displacement of a spool holder and is itself displaceable by the spool holder.

SUMMARY OF THE INVENTION

It is an object of the present invention to provide a spooling mechanism which, starting from any desired position, a spool holder can be moved through a particular distance by a servomotor, this distance being independent of the actual, instant position of the spool holder from which the servomotor initiates the further displacement.

According to the present invention, a pretension working element is provided for causing joint motion of a guide member of a servomotor together with a working member during its displacement by a spool holder, in order to maintain an unchanged, predetermined, relative position between the working member and the guide member of the linear servomotor during motions of the spool holder. A locking mechanism, actuatable by an operating device, which is preferably a clamping or wedging mechanism, is provided. In its clamped position, the operating device makes it possible for the working member to execute a working stroke relative to the guide member while also taking along the spool holder. Other types of locking mechanisms can be provided in place of the preferably provided clamping or wedging lock. In known lift-off mechanisms for textile spools on spool mechanisms, the lift-off position of the spool holder is unchangeable so that the distance of the lift-off spool from the winding shaft (drive drum or the like) varies, depending on the instant diameter of the spool. Thus, when the spool is lowered onto the winding shaft, a full spool traverses a smaller distance than does the almost empty spool, the difference being approximately the thickness of the winding.

In open-end spinning frames, the lifting mechanism according to the invention can achieve that, after a thread breakage, the reattachment of the thread is effected by moving the end of the thread back into the spinning rotor through a particular distance determined by the reverse stroke of the lifting mechanism. Prior to lifting the spool off the winding shaft, the thread can be held fast so that when the spool is lifted off the winding shaft, the thread can be held fast so that, when the spool is lifted off, a length of thread corresponding to the stroke of the spool is wound off (or a desired length of thread can be wound off the spool in some other suitable manner). Thus, because thread breakage practically always occurs in the vicinity of the fiber-collection channel or groove in the interior of the spinning rotor, a length of thread sufficient for the reattachment of the thread can be delivered back into the spinning rotor when the spool is lowered. The stroke of the lifting mechanism, therefore, needs to be only so large that the length of thread required for reattachment is delivered back to the spinning rotor when the spool is lowered down onto the winding shaft. The length of this thread is independent of the actual diameter of the spool.

DETAILED DESCRIPTION OF THE PREFERRED EMBODIMENTS

Figure 1:
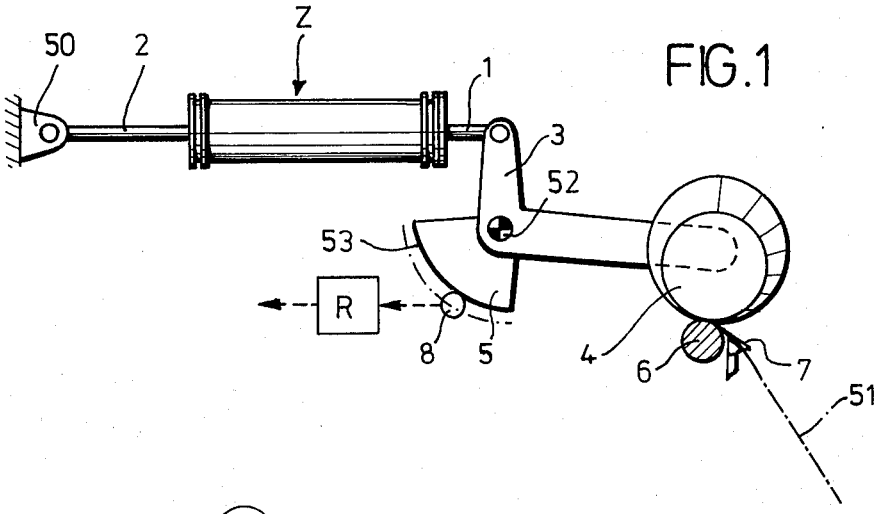
FIG. 1 is a side view of a spooling mechanism of a spinning machine with a lifting mechanism according to the first exemplary embodiment of the present invention.
Figure 2:
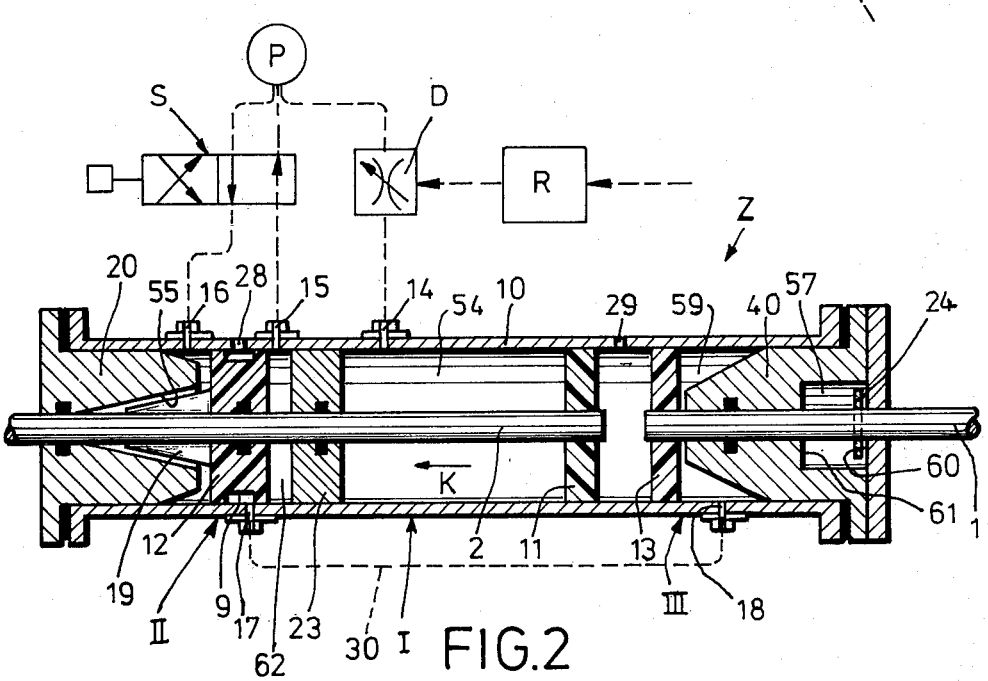
FIG. 2 is a longitudinal section through the lifting mechanism of FIG. 1, in enlarged representation, with an associated control circuit, shown schematically.

As illustrated in FIGS. 1 and 2, a spooling mechanism, according to an exemplary embodiment of the present invention, includes a servomechanism Z. The servomechanism is a combination of three piston cylinder units I, II, and III to which there is assigned a common cylinder or guide member 10. A first piston rod 1 is connected with one arm of a pivotably mounted spool holder 3 embodied as an angled lever. A second piston rod 2 is pivoted at a stationary bearing 50. The other arm of the spool holder 3 rotatably carries a cross-winding spool 4, whose circumference presses against a driven winding shaft or winding drum 6 or the like. A reciprocating thread guide 7 winds a thread 51 onto the spool 4 so that the diameter of the spool 4 steadily increases during the windup process and, therefore, the angular position of the spool holder 3 continuously changes.

The spool holder 3 is rotatably mounted on a locally fixed pivotal axis-defining member 52 and a cam plate 5 is fixedly disposed thereon. The contour 53 of this cam plate 5 is followed by a sensing roller 8. This sensing roller 8 influences a regulating or control instrument R which can set a pressure control valve (pressure reduction valve) D (FIG. 2) whose action and effect is to be explained in more detail below.

As shown in FIG. 2, the piston-cylinder unit I forms a pretensioning working element and includes a piston 11 fixedly connected to the piston rod 2 and further includes the intermediate, cylinder bottom 23 and that section of the cylinder housing 10 associated therewith. An intermediate cylinder bottom 23 is fixedly connected to the cylinder housing 10 so that, when a pressurized medium is delivered from a pressurized medium source P by a pressure control valve D, and introduced through a cylinder opening 14 into the chamber 54 of the cylinder under controllable pressure, it is possible to exert a force on the intermediate cylinder bottom 23 in the direction of arrow K which can move it in the direction of the arrow K and which also reduces the pressure by which the spool 4 presses against the winding shaft or drum 6, in a manner yet to be described. It should be pointed out here that under normal conditions at least, the pressure in the chamber 54 is set only so high that the cylinder housing 10 can just follow the motions of the piston rod 1 but not so high that the piston rod 1 can be actuated by this pressure to lift off the spool 4 from the winding shaft or drum 6, because the servomotor III is provided for this purpose.

The second piston-cylinder unit II forms an operating device or actuating mechanism of a clamping lock and includes a piston 12 provided with a peripheral annular control groove 9 and also slidably disposed within the cylinder housing 10; it further includes the intermediate, cylinder bottom 23 and a cylinder bottom 20. Fastened to the piston 12 are two conical elastic wedges 19 which can be pressed into a hollow conical wedging surface 55 of the cylinder bottom 20 for the purpose of blocking or locking the cylinder bottom 20, and hence the cylinder housing 10 on the piston rod 2. It is possible, if desired, to provide a collet in place of the wedges 19. The cylinder bottom 20 is screwed on the cylinder housing 10. The cylinder housing region of the second piston-cylinder unit II contains two apertures 15 and 16 for passing the pressurized medium and a third aperture 17. A pressure medium source P, for example, a pressure medium pump with an associated storage container, is connected, via a control slide S, with the apertures 15 and 16 for the purpose of admitting pressurized medium to the piston 12.

The third piston-cylinder unit III forms a servomotor for lifting the spool 4 from the winding shaft or drive drum 6 and contains a piston or working member 13, fixedly connected to the piston rod 1. The freedom of motion of the piston 13 is limited, on both sides, by an insert or pin 24, fastened to the piston rod 1, which moves between two stops 60 and 61 formed by the faces of a chamber 57 located within a cylinder cover 40. The piston rod 1 is pivotably mounted at the spool holder 3 (FIG. 1). The section of the cylinder housing 10 belonging to the third piston-cylinder unit III is provided with an aperture 18 for pressurized medium through which pressurized medium, admitted through a line 30 connected to an aperture 17, can be conducted to and from a working chamber 59 and can act on the right side of the piston 13. The cylinder housing 10 further includes relief slits 28 and 29.

The method of operation of the above-described mechanism will be explained with the aid of an example including a thread delivered by a spinning frame, preferably by an open-end spinning frame, but it also can be used in combination with other machinery, for example, spooling, or twisting machines.

The thread 51 is delivered to the spool 4 by the thread guide 7 and by the winding shaft or drum 6 driving the spool 4. The circumference of the spool 4 presses onto the driven winding shaft or drum 6 which results in winding the thread 51 on the spool 4.

Figure 3:
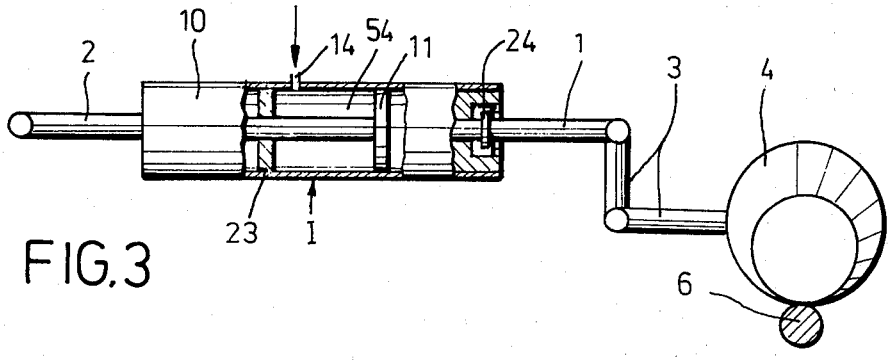
FIGS. 3 – 6 are respective side views of the lifting and spooling mechanism of FIG. 1, in partially sectional representation and in different positions, these figures aiding in explanation of the method of operation of the lifting mechanism, FIG. 3 illustrating operations of a pretension working member, FIG. 4 illustrating operation of an actuating device of a clamping lock, FIG. 5 illustrating the function of a servomotor, and FIG. 6 showing the unlocking of the clamping lock.
Figure 4:
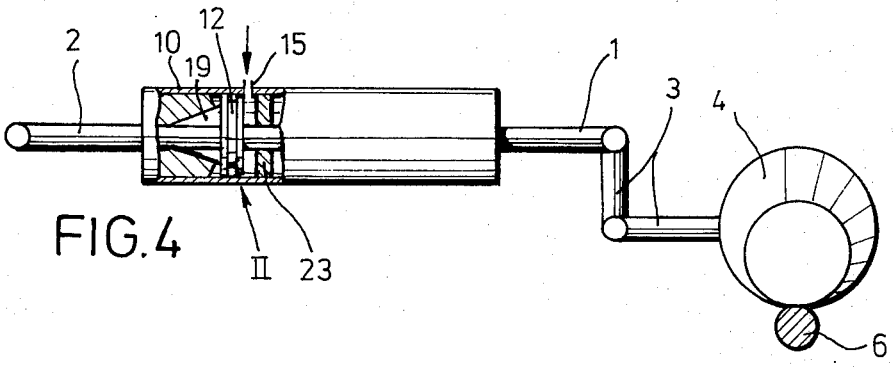
Figure 5:
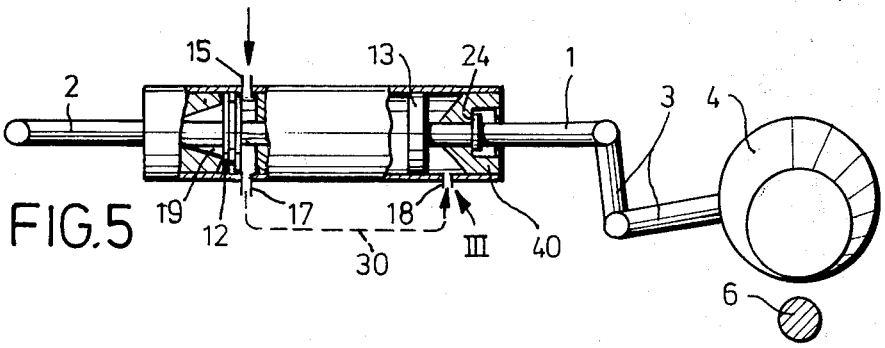
Figure 6:
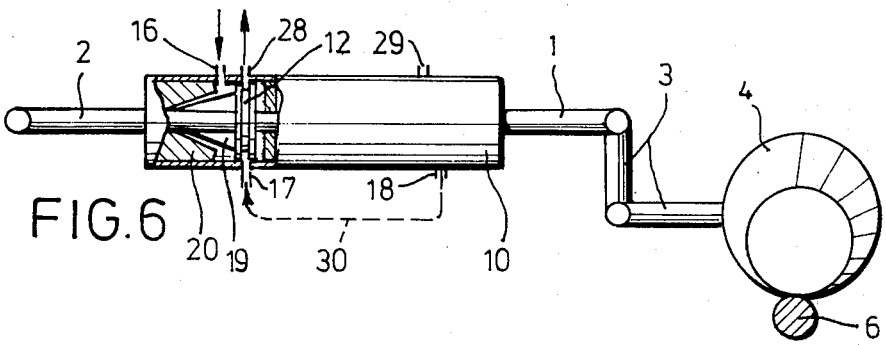

While the thread 51 is being wound up, according to FIG. 3, the piston 11 of the pretensioning working piston-cylinder unit I is acted upon by a pressure medium admitted through an inlet constituted by the opening 14, into the chamber 54. Since the piston 11 cannot move axially because of its locally pivoted piston rod 2, the pressure medium admitted to the chamber 54 moves the intermediate cylinder bottom 23 and hence, also the cylinder housing 10, containing the piston rod 1, so that the pin 24 makes contact with the stop 60. For this purpose, the pressure of this pressure medium is so adjusted that it is not capable of lifting the spool 4 from the winding shaft or drum 6, but is capable of carrying the cylinder housing 10 along with the piston rod 1. In this position of the pin 24, the piston 13 (FIG. 2) has its extreme right-most position relative to the cylinder housing 10, and thus can at any time execute a working stroke to the left of constant length within the cylinder housing 10 when the pressure medium is admitted into the working chamber 59 until the pin 24 touches the stop 61, and this occurs, for example, whenever thread breakage takes place so that the spool 4 is lifted off from the winding shaft or drum 6 by a particular fixed distance for the purpose of repairing the thread breakage, this distance being independent of the actual, current diameter of the spool 4. This lift-off function is caused by shifting the control slide S from the position shown in FIG. 2 into the other control position which causes, firstly, that the pressure medium source P supplies pressure medium to the piston 12 of the piston-cylinder unit II of the locking mechanism and it flows through an inlet opening 15 into a chamber 62 and moves the piston 12 to the left (FIG. 4). During this process, the elastic wedges 19 of the piston 12 are pressed into the hollow, conical surface 55 of the bottom 20 and are jammed against the piston rod 2 and, therefore, hold the bottom 20, and hence the cylinder housing 10, fixed with respect to the piston rod 2 so that it can no longer slide axially on the piston rod 2. Since the piston rod 2 is not axially movable, any axial movements of the cylinder housing 10 are thus prevented. In this wedged position of the lock, constituted by the wedges 19, and the surface 55, i.e., in the left-most final position of the piston 12, the piston 12 opens the outlet aperture 17 (FIG. 5), so that the pressurized medium flows through the chamber 62 through the line 30 and the inlet aperture 18 into the working chamber 59. This moves the piston 13 to the left until the pin 24 makes contact with the stop 61. Due to this constant and precisely limited stroke and by virtue of the piston rod 1 and the spool holder 3, the spool 4 is lifted up from winding the shaft or drum 6 by a predetermined, fixed distance which is independent of the actual, current diameter of the spool 4.

It is to be understood that the lift-off distance of the spool 4 from the winding shaft or drum 6 can be diminished by the insertion of spacers in the chamber 57 of the cover 40 or can be increased by the extension of chamber 57. If it is intended to lower the spool 4 back onto the winding shaft or drum 6, (which, in the case of an open-end spinning machine leads to the reattachment of the thread and subsequently to the winding up of the produced thread), the control slide S is shifted into the position shown in FIG. 2 which permits the pressurized medium to flow through the inlet aperture 16 and into the interior volume of the cylinder between the cylinder bottom 20 and the piston 12 which acts upon the left side of the piston 12. As a consequence, the piston 12 moves to the right and releases the wedging action of the cylinder bottom 20 and hence of the cylinder housing 10. In the extreme right position of the piston 12, the control groove 9 in the piston 12 connects the cylinder aperture 17 with the outlet relief slit 28. This relieves the working chamber 59 of the servomotor piston-cylinder unit III, through the outlet aperture 18 and the line 30; the piston 13 moves to the right and then lowers spool 4 onto the winding shaft or drum 6, whereby the thread 51 can migrate backward, opposite to its normal direction of motion, by a corresponding amount of thread length.

The piston-cylinder unit I has the primary purpose of holding the entire piston-cylinder unit Z (FIG. 1) under a pretension whose effect during the windup operation is that the stop 60 is held in contact with the pin 24, so that the entire cylinder moves along with the piston rod 1 and with the piston 12, and that the piston 12 when required, can, at any time execute its complete working stroke for lifting off the spool 4, irrespective of the position in which the piston rod 1 may be with respect to the spool 4.

If it is intended that the working piston-cylinder unit I is also to be used as a relief working element for the controlled reduction of the contact pressure of the spool 4 on winding shaft or drum 6, then the pressure control (reduction) valve D, which is inserted in the supply line of the pressure medium between the pressure medium source P and the inlet opening 14 of this working unit I, can be controlled by the controller or regulator instrument R which is itself controlled by the cam plate 5 on the spool holder 3 in such a way that the contact pressure of the spool 4 remains approximately constant. With increasing spool windup, the spool 4 gets heavier and its diameter gets larger. The higher weight has an undesirable effect on the contact pressure of the spool 4 on the winding shaft or drum 6. The increasing weight of the spool 4 has a direct connection with its diameter and, hence, with the position of the spool holder 3. The position of the spool holder 3 is detected by means of the cam plate 5 and the sensing roller 8. This measured parameter value is fed to the control or regulator instrument R and is converted there into a control signal which is delivered to the pressure reduction valve D for its control, the entire process being that the pressure control (reduction) valve D so controls the pressure acting on the piston 11 of the working unit I, that the entire piston-cylider unit Z pulls on the spool holder 3 via the piston rod 1 in such a way that the increasing weight of the spool 4 is approximately equalized, i.e., that the contact pressure of the spool 4 on winding shaft or drum 6 remains approximately constant. However, it is possible to store other programs in the control instrument R which could effect a different program for the relief of the spool holder 3, so that the contact pressure of the spool 4 from the winding shaft or drum 6 during the winding can be influenced arbitrarily either to increase or decrease. The embodiment of such control or regulating instruments is known and need not be described further here.

Figure 7:
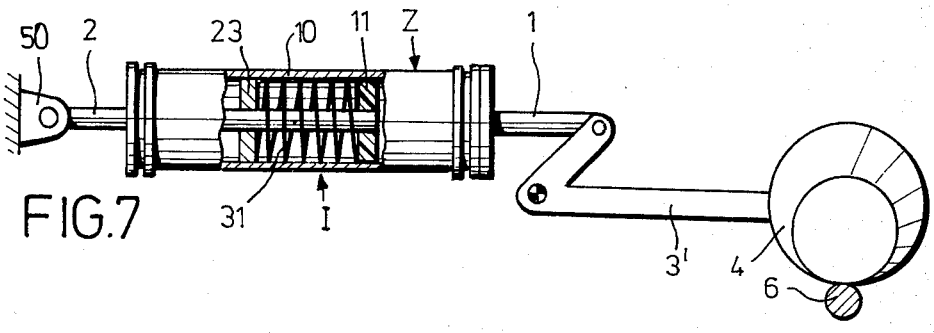
FIG. 7 is a side view of a variant of the mechanism of FIG. 1, partially in section.

In the sometimes advantageous embodiment of forms of the servomechanism Z, illustrated in FIG. 7, the pretensioning working piston-cylinder unit I is provided with a spring 31 positioned about the piston rod 2 within the cylinder housing 10. The remaining parts of the servomechanism can be embodied as shown in FIG. 2. The spring 31 also has the task of taking along the cylinder housing 10 together with the piston rod 1 so that the piston 13 (not visible in FIG. 7) of the servomotor Z is held in the terminal position within the cylinder housing 10 from which it can execute a working stroke starting at any arbitrary position of the spool holder 3'. The effect of the spring 31 is the same as a pressure pad between the piston 11 and the intermediate, cylinder bottom 23.

Figure 8:
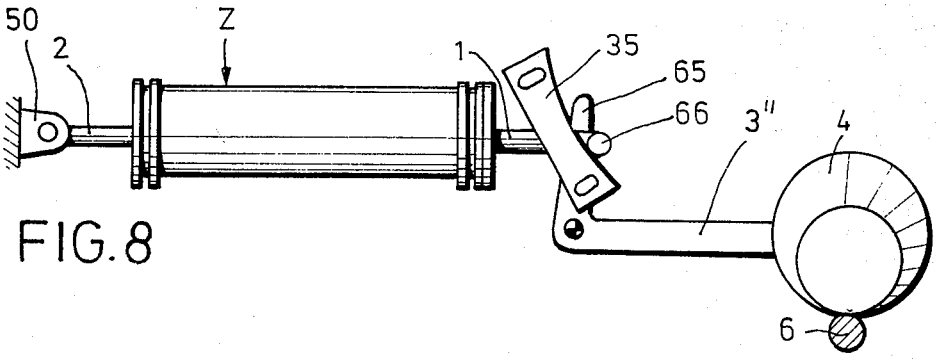
FIG. 8 is a side view of a further variant of FIG. 7.

When the diameter of the spool 4 increases, the spool holder 3' is pivoted and the spring 31 is extended. This reduces its force. At the same time, however, the weight of the spool 4 increases, which would require not a decreasing, but an increasing spring force for equalization. In order to achieve this equalization according to FIG. 7, the piston rod 1 is pivoted to one arm of the spool holder 3', whose effective lever arm is increased during increasing pivoting of the spool holder 3', and hence produces the desired equalization. In FIG. 8, the servomotor Z can be embodied as in FIG. 7. In FIG. 8, the required equalization is achieved in that the point of attack of the piston rod 1 at an associated arm 65 of the spool holder 3'' is guided upwardly along the arm of the spool holder 3'', by a locally fixed control cam 35, whose position and inclination can be adjusted, during an increasing pivoting of the spool holder 3''. This increases the length of the lever arm and hence also the relief torque exerted by the spring 31 (FIG. 7). It is suitable for this purpose that the arm 65 is provided with for example, an elongated hole engaged by a straight pin on the piston rod 1 or else the arm 65 can be guided by a fork disposed on the piston rod 1 or vice versa. An angled end 66 of the piston rod 1 makes contact with the control arm surface 35.

Figure 9:
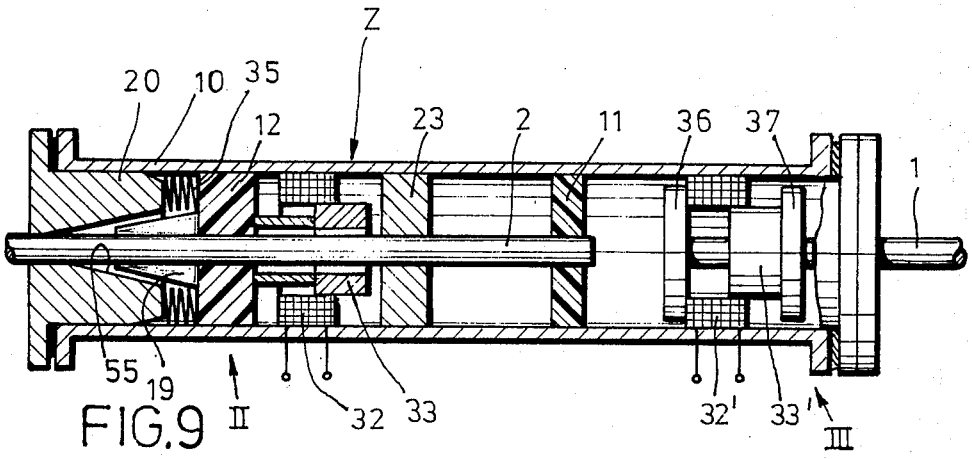
FIG. 9 is a side view of a fifth exemplary embodiment of a lifting mechanism according to the present invention, in longitudinal section.

FIG. 9 shows an often advantageous embodiment of the locking mechanism including an actuating piston-cylinder II, as well as the servomotor piston-cylinder unit III, embodied as electromagnetic setting members.

These setting members include field coils 32, 32', fixedly disposed within the cylinder housing 10 and connected with a current source and cooperating respectively with armatures 33, 33' fixedly connected to disc piston 12 and the piston rod 1. When the field coil 32 is excited, the working member or armature 33 of actuating piston-cylinder unit II displaces the disc piston 12 to the left against the force of at least one spring 35 and therefore causes, as described above, the locking of the cylinder bottom 20 on the piston rod 2 by virtue of the locking mechanism constituted by the elastic wedges 19 and the surface 55. When the current is shut off, the spring 35 again pushes the disc piston 12 to the right and releases the wedgeing action.

When the field coil 32' is excited, the armature 33' of servomotor piston-cylinder unit III executes its working stroke which, as described above, lifts the spool 4 from the winding shaft or drum 6. The length of the stroke is limited and determined by the two armature plates 36 and 37, which alternately made contact with the coil 32'.

It is to be appreciated that the foregoing detailed description and accompanying drawing illustrations are set out by way of example and not by way of limitation. Numerous other embodiments and variants are possible with the spirit and scope of the invention, the scope being defined in the appended claims.

What is claimed is:

1. In a spooling mechanism for the winding of textile threads onto spools having a driven winding shaft; at least one spool whose circumference presses against the driven winding shaft; a pivotably mounted spool holder on which the spool is mounted for rotation, said spool holder being pivoted during increasing spool diameter with further pivoting permitting lifting the spool off from its associated winding shaft; and a linear servomotor, which has a working member and an associated guide member, which working member is connected to the spool holder and is mounted to be driven with respect to the guide member for the purpose of executing a displacement, the working member serving for the displacement of the spool holder and being itself displaceable by the spool holder, the improvement comprising: a pretension working element connected to the linear servomotor for causing the joint motion of said guide member of said linear servomotor together with said working member during displacement of the working member by said spool holder to maintain a substantially unchanged, predetermined, relative position between said working member and said guide member of said linear servomotor during motions of said spool holder; an operating device; and locking means, actuatable by said operating device, which in its locking position allows said working member to execute a working stroke relative to said guide member while taking along said spool holder.

2. An arrangement according to claim 1, wherein said locking means comprises a wedging or clamping mechanism.

3. An arrangement according to claim 1, wherein said locking means, in its locked position, blocks motions of said pretension working element.

4. An arrangement according to claim 1, wherein said operating device of said locking means, said servomotor and said pretension working element comprise three respective hydraulic or pneumatic piston-cylinder units.

5. An arrangement according to claim 4, wherein each of said three piston-cylinder units includes a respective different piston disposed in a common cylinder housing, which comprises said guide member of said servomotor.

6. An arrangement according to claim 5, which further comprises servo control means, and wherein at least said pistons of said locking means and said servomotor are actuated by said servo control means.

7. An arrangement according to claim 6, wherein said piston of said operating device of said locking means is a control piston which controls actuation of said piston of said servomotor after the motion of said cylinder housing of said servomotor is blocked, and permits emptying of the working volume of said servomotor after motion of said cylinder housing of said servomotor is released.

8. An arrangement according to claim 7, which further comprises a pressure medium conduit opening into said cylinder of said locking means at one end, and into said cylinder of said servomotor at an opposite end, wherein said piston of said operating device of said locking means, when located in a position where it blocks motion of said cylinder housing, opens an outlet of said cylinder housing to said conduit through which pressure medium acting upon it can be further conducted to said piston-cylinder unit constituting said servomotor.

9. An arrangement according to claim 8, wherein said cylinder of said locking means has a relief outlet, and wherein said piston of said operating device of said locking means is provided with a control groove by which said outlet to said conduit, leading to said servomotor, is connected with said relief outlet when said piston of said locking means is in a position in which it releases motion of said cylinder housing.

10. An arrangement, according to claim 5, wherein two sides of said piston of said locking means can be alternately acted upon by pressure medium.

11. An arrangement according to claim 1, wherein said pretension working element serves as a relief means for adjusting contact pressure of said spool on said winding shaft.

12. An arrangement according to claim 11, which further comprises a sensor and a pressure control valve, and wherein the pivotal position of said spool holder is detected by said sensor and said pressure control valve is settable in dependence on this pivotal position, said control valve being arranged to control the pressure of the medium acting upon said pretension working element.

13. An arrangement according to claim 12, including control cam means in contact with said spool holder for effecting actuation of said pretension working element according to a program in dependence on the pivotal position of said spool holder, and wherein said control cam means sets said pressure control valve which controls the pressure medium acting upon said pretension working element.

14. An arrangement according to claim 5, wherein blockage of the motion of said cylinder housing of said servomotor occurs by wedging a locally stationarily pivoted pull rod with respect to said cylinder housing.

15. An arrangement according to claim 14, wherein the wedging of said pull rod of said pretension working element is effected by at least one wedge-shaped elastic clamping member which can be pressed by said operating device of said locking means between a conical surface disposed at the housing of said operating device of said locking means and said pull rod.

16. An arrangement according to claim 1, wherein said working member of said servomotor can be moved over a distance which corresponds to a predetermined, small lift-off path of said spool from said winding shaft.

17. An arrangement according to claim 1, wherein said pretension working element comprises spring means.

18. An arrangement according to claim 17, wherein said spool holder comprises a lever, and wherein said spring means engage said spool holder via a lever arm of said lever whose effective length is changeable in dependence on the pivotal position of said spool holder, in such a way that the spring tension of said spring means, corresponding to the characteristic curve thereof, is at least approximately compensated.

19. An arrangement according to claim 18, wherein the length of the lever arm at which the force of said spring means engages said spool holder is changeable in such a way that both the spring force, which increases or decreases according to the pivotal position of said spool holder, as well as the increasing weight of said spool, are at least approximately compensated for.

20. An arrangement according to claim 19, wherein said lever is an angled lever, and further comprising a force transmission member of said servomotor connected to the working member, and a locally affixed and adjustably disposed guide cam means for displacing the pivotal point of the force transmission member of said servomotor in dependence on the pivotal position of said angled lever, along one arm of thereof whose other arm carries said spool.

21. An arrangement according to claim 1, wherein said operating device of said locking means is embodied as as electromagnetic servo member.

22. An arrangement according to claim 1, which further comprises at least one spring, wherein said servomotor is embodied as an electromagnetic motor acting against the force of the at least one spring.

* * * * *